US005203719A

United States Patent [19]

Kozono

[11] Patent Number: 5,203,719

[45] Date of Patent: Apr. 20, 1993

[54] LOCK ASSURANCE MECHANISM FOR CONNECTOR

[75] Inventor: Seiji Kozono, Shizuoka, Japan

[73] Assignee: Yazaki Corporation, Tokyo, Japan

[21] Appl. No.: 801,925

[22] Filed: Dec. 3, 1991

[30] Foreign Application Priority Data

Dec. 14, 1990 [JP] Japan ..... 2-410617

[51] Int. Cl.[5] ..... H01R 13/627

[52] U.S. Cl. ..... 439/489; 439/357

[58] Field of Search ..... 439/345, 347, 350, 351-358, 439/489

[56] References Cited

U.S. PATENT DOCUMENTS 4,433,888 2/1984 Winger ..... 439/357
4,950,179 8/1990 Takenouchi et al. ..... 439/357
4,993,967 2/1991 Matsumoto ..... 439/489

FOREIGN PATENT DOCUMENTS 1166997 11/1989 Japan .

*Primary Examiner*—Larry I. Schwartz
*Assistant Examiner*—Hien D. Vu
*Attorney, Agent, or Firm*—Sughrue, Mion, Zinn, Macpeak & Seas

[57] ABSTRACT

A lock assurance mechanism for a connector having a pair of housings. A lock assurance member is attached to one housing having a lock arm in such a manner that the lock assurance member is movable back and forth relative to the housing, the lock assurance member having a flexible retaining lever with a retaining pin at a free end thereof. A guide wall having a guide holder for supporting the retaining pin is formed upright on the housing. A back-and-forth movement limitation piece for limiting back and forth movement of the retaining pin is provided on the other housing. When the housings are fitted together to engage the lock arm with a lock retaining portion, the retaining pin abutted against the back-and-forth movement limitation piece is disengaged from the guide holder to allow the displacement of the flexible retaining lever; and subsequently by moving the lock assurance member, the retaining pin is brought into engagement with a rear surface of the back-and-forth movement limitation piece, thereby completely retaining the flexible retaining lever relative to the former housing.

4 Claims, 5 Drawing Sheets

LOCK ASSURANCE MECHANISM FOR CONNECTOR

BACKGROUND OF THE INVENTION

This invention relates to a lock assurance mechanism for securing the fitting and locking between female and male housings of a connector used for interconnecting wire harnesses.

An electric wiring system for an automotive vehicle, such for example as a safety circuit for an air bag, is concerned directly with a human life in the event of an emergency, and therefore it is necessary to take such measures that incomplete fitting and locking, or an incomplete contact resulting therefrom, will not develop at connected portions made by a connector.

In view of this, the Japanese Utility Model Unexamined Publication No. Hei. 1-66977 has proposed a lock assurance mechanism, as shown in FIG. 8, in which when a male housing b is fitted in a female housing a, engagement release levers f displace flexible retaining pieces c1 of a lock assurance member c to release provisional engagement of these retaining pieces with retaining projections b1, and by moving the member c, an incomplete fitting of a connector is detected. In this Figure, reference character a1 denotes a hood, reference character a2 a lock chamber, reference character d a lock arm having a retaining projection d1, and reference character e a retaining hole for engagement with the retaining projection d1.

In the lock assurance mechanism shown in FIG. 8, when or after the female and male housings a and b are disconnected from each other, it is necessary to reset the lock assurance member c so as to provisionally engage the flexible retaining pieces c1 with the retaining projections b1. If this is neglected, it is impossible to detect an incomplete fitting at the time of the next fitting, and it has been pointed out that the operation is cumbersome and that defective products tend to be produced.

SUMMARY OF THE INVENTION

With the above problems in view, it is an object of this invention to provide a lock assurance mechanism by which whether a fitted and locked condition is good or not can be positively judged even if a lock assurance member is not reset when female and male housings are disconnected from each other.

The above object has been achieved by a lock assurance mechanism for a connector in which a lock arm is provided on an outer wall of one of a pair of female and male housings so as to be displaced about a fulcrum, said housings receiving metal terminals; a lock retaining portion for engagement with said lock arm is provided on the other of said housings; and said female and male housings are locked together upon fitting of said two housings relative to each other; CHARACTERIZED in that:

a lock assurance member is attached to said one housing having said lock arm in such a manner that said lock assurance member is movable back and forth relative to said one housing, said lock assurance member having a flexible retaining lever which extends along said lock arm and has a retaining pin at a free end thereof; and a guide wall having a guide holder for supporting said retaining pin is formed upright on said one housing;

a back-and-forth movement limitation piece for limiting back and forth movement of said retaining pin is provided on said other housing; and when said female and male housings are fitted together to engage said lock arm with said lock retaining portion, said retaining pin abutted against said back-and-forth movement limitation piece is disengaged from said guide holder to allow the displacement of said flexible retaining lever; and subsequently by moving said lock assurance member, said retaining pin is brought into engagement with a rear surface of said back-and-forth movement limitation piece, thereby completely retaining said flexible retaining lever relative to said one housing.

In the lock assurance mechanism of the present invention, as in the conventional art, when the pair of female and male housings are fitted together, they are locked together through the engagement of the lock arm with the lock retaining portion. However, from the start of the fitting to the end thereof, the retaining pin of the flexible retaining lever is abutted against the front surface of the back-and-forth movement limitation piece provided, for example, on the female housing, and is also supported by the guide holder, and therefore the lock assurance member can not move in the fitting direction.

Then, by the above fitting and locking, the retaining pin is disengaged from the guide holder, and therefore the retaining pin slidingly contacts the lower surface of the back-and-forth movement piece, so that the flexible retaining lever is flexed. Thus, the lock assurance member can move, and when the retaining pin engages the rear surface of the back-and-forth movement limitation piece, the above assurance member is retained.

After releasing the above fitting and locking, the male housing is withdrawn from the female housing, so that the lock assurance member moves together with the male housing because of the retraction of the guide holder.

Thus, the lock assurance member assures the complete fitting and locking of the female and male housings relative to each other, and when they are to be disconnected from each other, the lock assurance member moves together with the male housing. Therefore, the cumbersome resetting heretofore required is not needed, and a good operability can be achieved.

In addition, the above-noted and other objects can also be achived by a connector comprising: a first housing with at least one terminal therein; a second housing adapted to be fitted to the first housing with at least one terminal mounted therein adapted to mate with the terminal of the first housing, the housings being relatively movable in a first direction with respect to one another toward a completely fitted position where the second housing is completely fitted to the first housing so that the terminals of the respective housings are in mating engagement; locking means for maintaining the housings in the completely fitted position; a lock assurance member attached to the first housing and movable in the first direction relative to the first housing, the lock assurance member having a body and at least one flexible retaining lever extending in the first direction from the body, the flexible retaining lever having a retaining pin at a distal end thereof; at least one guide holder formed on the first housing, the guide holder having a first surface portion extending in the first direction and a second surface portion inclined with respect to the first direction; and at least one back-and-forth movement limitation piece formed on the second housing, the movement limitation piece having first and second tapered ends apart from each other a predetermined distance in the first direction; and wherein during the movement of the housings relative to each other in the first direction toward the completely fitted position the first tapered end and the first surface portion form a first nip retaining the retaining pin therein to prevent the lock assurance member from being moved relative to the second housing, and at the completely fitted position of the housings the second tapered end and the first surface portion form a second nip and the first tapered end and the first surface portion allow the retaining pin to be slidingly moved along the second surface portion toward the second nip, to thereby allow the lock assurance member to be moved in the first direction relative to the second housing and retain the retaining pin in the second nip.

DESCRIPTION OF THE PREFERRED EMBODIMENT

Figure 1:
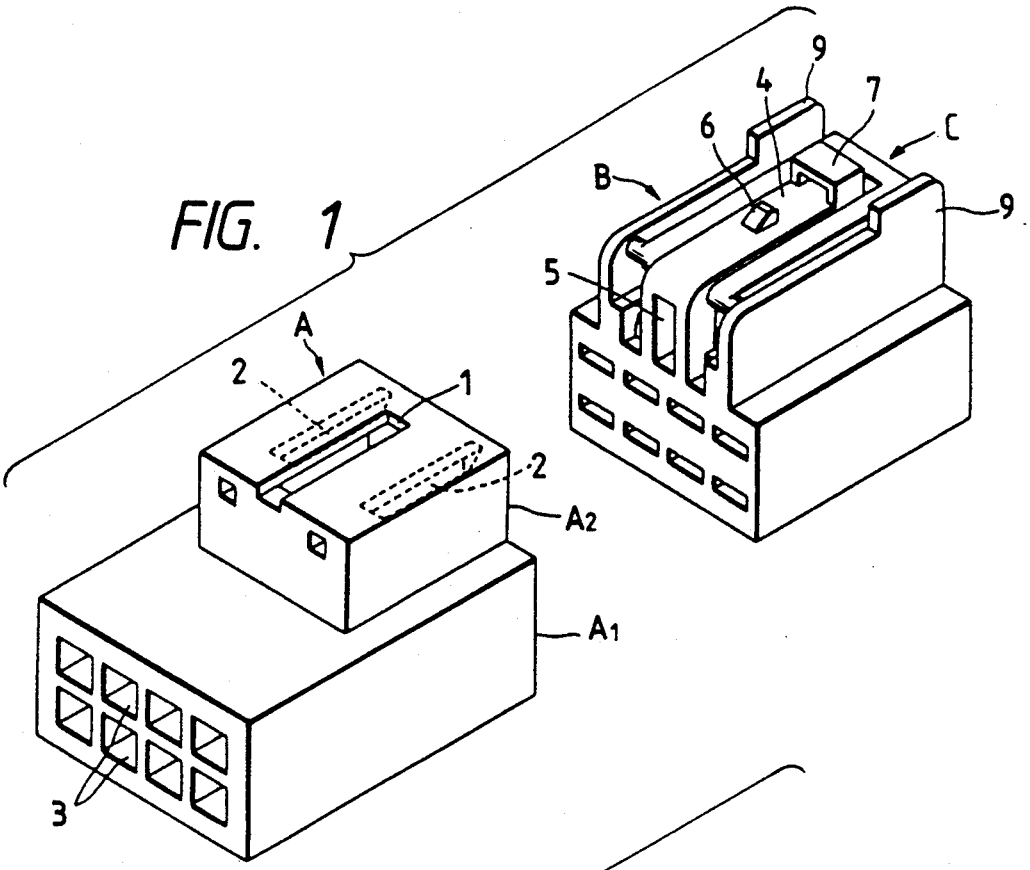
FIG. 1 is a perspective view of one preferred embodiment of the present invention, showing female and male housings as separated from each other.
Figure 2:
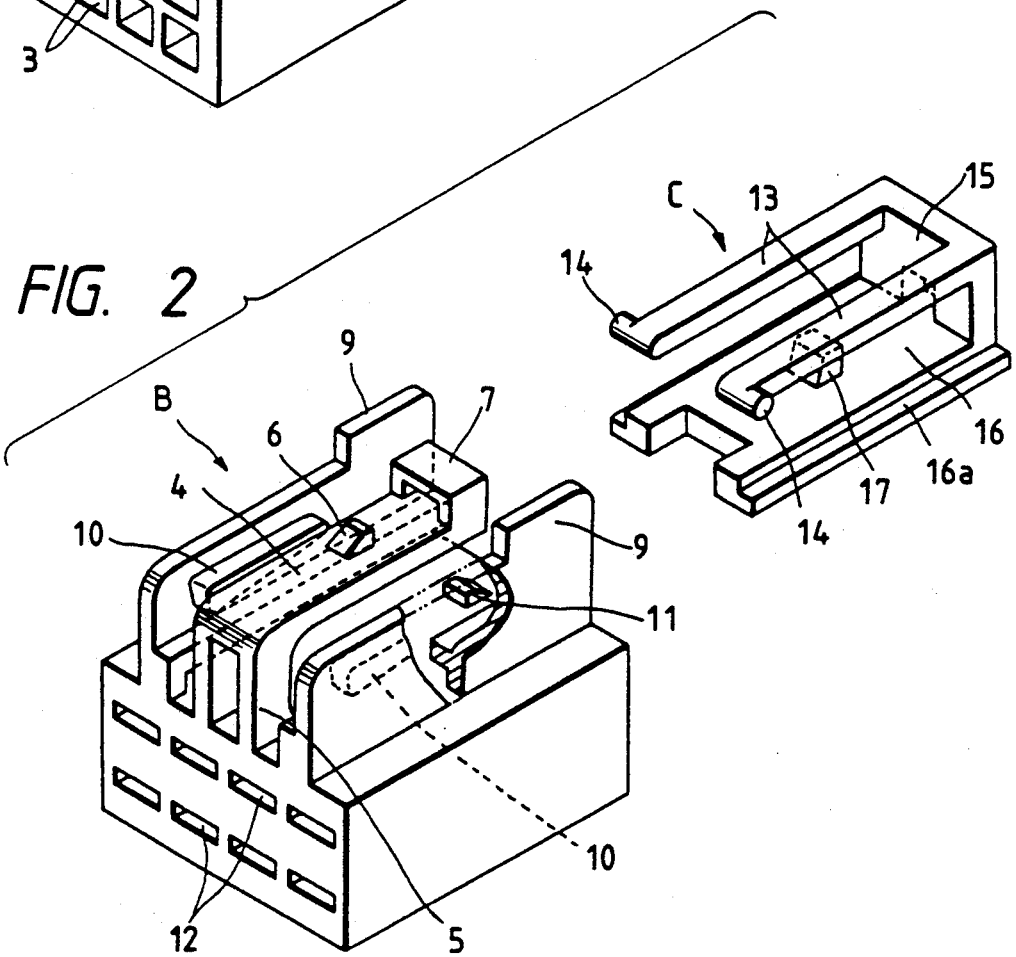
FIG. 2 is a partly-broken, perspective view showing the male housing and a lock assurance member as separated from each other.
Figure 3A:
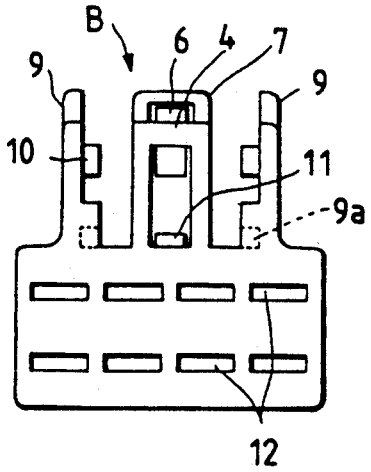
FIGS. 3A and 3B are a front-elevational view of the male housing and a vertical cross-sectional view through a central portion thereof, respectively.
Figure 3B:
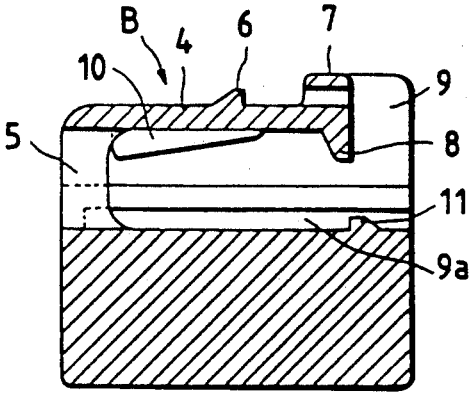
Figure 4A:
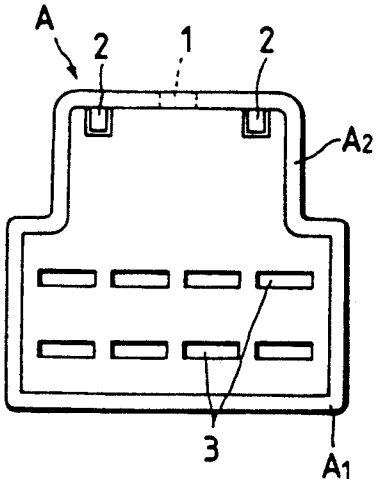
FIGS. 4A and 4B are a front-elevational view of the female housing and a vertical cross-sectional view through a central portion thereof, respectively.
Figure 4B:
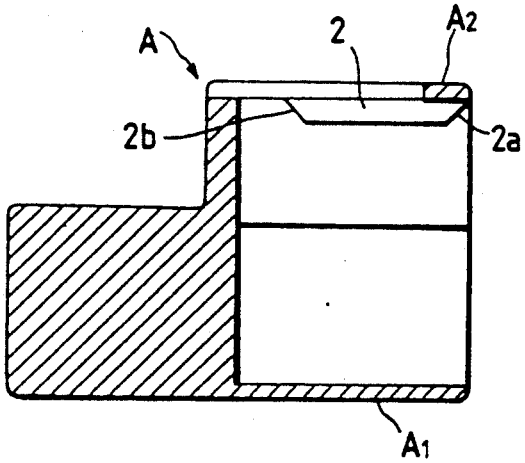

In FIGS. 1 to 5, reference character A denotes a female housing of a synthetic resin, reference character B a male housing, and reference character C a lock assurance member. Male and female metal terminals (not shown) are received respectively in terminal receiving chambers 3 and 12 of the pair of female and male housings A and B constituting a connector. The lock assurance member C is mounted on the male housing B so as to move back and forth along a lock arm 4 of the male housing.

The female housing A has at its front half portion a hood A1 having a lock chamber A2, and a retaining hole 1 for the lock arm 4 is formed through a central portion of a top wall of the lock chamber A2. Two elongated back-and-forth movement limitation pieces 2 are formed on the inner surface of this top wall, and are disposed on the opposite sides of the retaining hole 1, respectively. The back-and-forth movement limitation pieces 2 limit the movement of the lock assurance member C, and the front and rear ends of each of the limitation pieces 2 are formed into tapered surfaces 2*a* and 2*b*, respectively.

The lock arm 4 provided at the outer wall of the male housing B extends rearwardly via a front upstanding proximal portion 5, and has at a central portion of its upper surface a retaining projection 6 for engagement with the retaining hole 1. A release thumb piece 7 is formed on the upper surface of the lock arm 4 at its rear end, and a passage prevention piece 8 for the lock assurance member C is formed on the lower surface of the lock arm 4 at the rear end thereof.

Figure 5A:
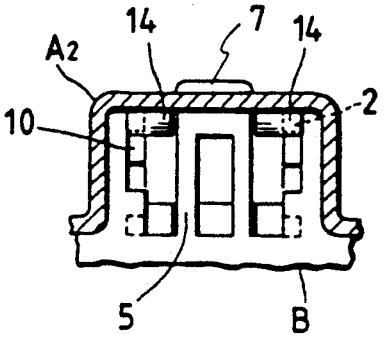
FIGS. 5A and 5B are a front-elevational view of an important portion, showing the condition of engagement of the lock assurance member with the female and male housings, and a vertical cross-sectional view thereof.
Figure 5B:
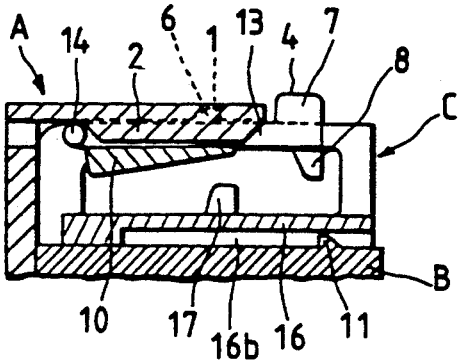

Guide walls 9 for the lock assurance member C are formed upright on the outer wall of the male housing B, and are disposed on the opposite sides of the lock arm 4, respectively. A provisional retaining projection 11 is formed at the central portion of the rear portion of the outer wall of the male housing. Guide holders 10 and 10 are formed respectively on the opposed surfaces of the guide walls 9 at their front half portions, and extend horizontally. Guide grooves 9*a* are formed respectively in the lower end portions of the opposed surfaces of the guide walls 9 over the substantially entire length thereof. The guide holders 10 support and outwardly directed, guide retaining pins 14 and flexible retaining levers 13 of the lock assurance member C. The lower surface of the guide holder 10 is defined by a tapered guide surface 10*a* slanting downward toward the front end thereof. As shown in FIG. 5B, when the female and male housings A and B are fitted together, the front end of the guide holder 10 is projected slightly beyond the back-and-forth movement limitation piece 2 whereas the rear end thereof is disposed inwardly of the piece 2.

The lock assurance member C has the pair of flexible retaining levers 13 and 13 designed to extend along the lock arm 4, and the guide retaining pins 14 are respectively formed on the free ends of the levers 13. The pair of flexible retaining levers 13 and 13 extend forwardly respectively from opposite side portions of a rear plate 15 at the upper end thereof, and are resiliently displaceable upward and downward. The rear plate 15 is formed upright on a rear end of a slide plate 16 which is adapted to be slidably mounted between the guide walls 9 and 9. The slide plate 16 has elongated projections 16*a* which are formed respectively at its opposite sides so as to fit respectively in the guide grooves 9*a* of the guide walls 9. The slide plate 16 has at its lower surface a retaining groove 16*b* in which the provisional retaining projection 11 of the male housing B is adapted to be fitted. Extending from the central portion of the upper surface of the slide plate 16 is an entry prevention piece 17. As discussed below and as illustrated in FIG. 6*c*, during insertion of the male housing B into the female housing A, the lock assurance member is prevented from being advanced more than a predetermined amount as the entry prevention piece 17 will engage the passage prevention piece 8 of the male housing B.

In the above construction, the elongated projections 16*a* at the opposite sides of the slide plate 16 are inserted respectively into the guide grooves 9*a* of the guide walls 9, so that the lock assurance member C is attached to the outer wall of the male housing B so as to move back and forth in a direction parallel to the direction of extension of the lock arm 4, as shown in FIG. 5B. When the lock assurance member is once attached, the provisional retaining projection 11 of the male housing B is engaged in the retaining groove 16*b* in the reverse surface of the slide plate 16, and therefore the lock assurance member C is provisionally retained relative to the male housing B. Therefore, the lock assurance member C will not become disengaged from the male housing B during storage and transport of the male housing B and during the fitting of the male housing into the female housing A.

Next, the fitting and locking of the female and male housings A and B relative to each other, as well as the operation of the lock assurance member C, will now be described with reference to FIGS. 6A to 6D and FIGS. 7A to 7D.

Figure 6A:
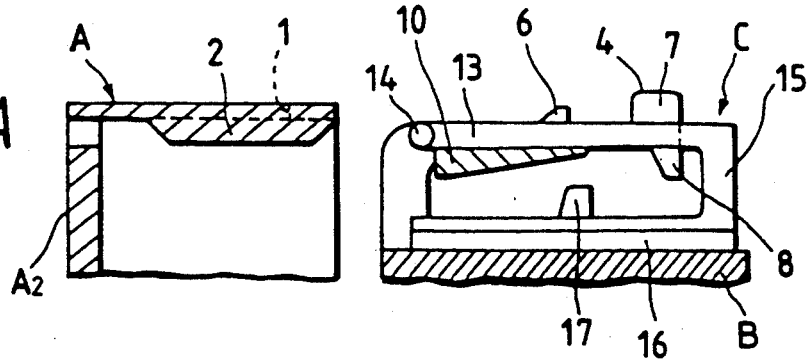
FIGS. 6A to 6D are cross-sectional views of an important portion, showing the process of fitting and locking between the female and male housings.

FIG. 6A shows the above provisionally-retained condition in which the lock assurance member C is attached to the male housing B, and the flexible retaining levers 13 as well as the retaining pins 14 are supported on the guide holders 10 of the guide walls 9, respectively.

Then, when the male housing B is inserted into the hood A1 of the female housing A, the retaining pins 14 supported by the respective guide holders 10 abut respectively against the tapered guide surfaces 2*a* at the front ends of the back-and-forth movement limitation pieces 2 provided within the lock chamber A2. As a result, only the male housing B advances as indicated by arrow P, with the lock assurance member C maintained in a fixed position.

Figure 6B:
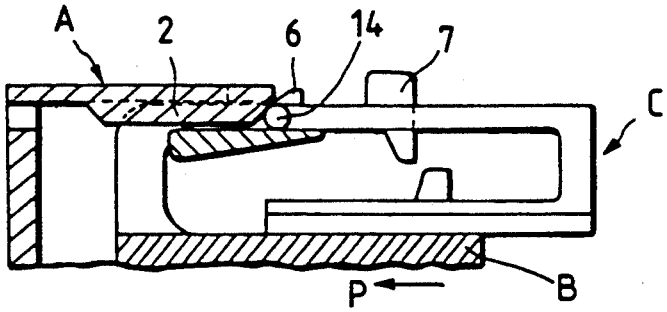
Figure 6C:
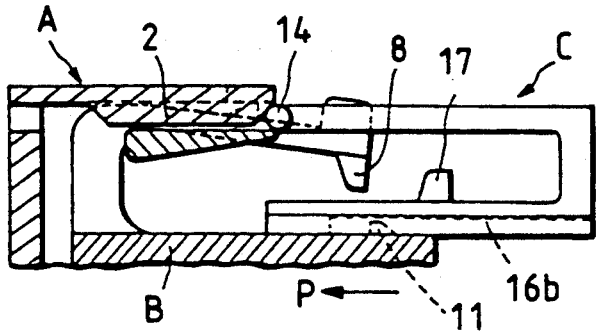
Figure 6D:
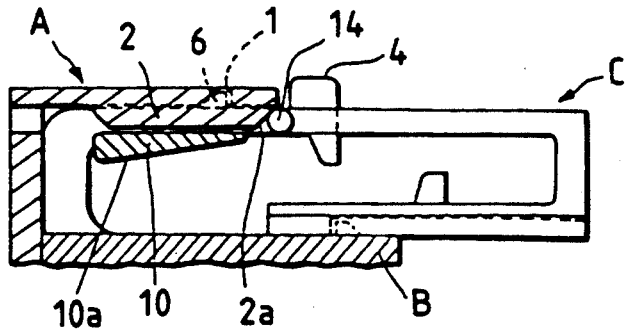

FIGS. 6B and 6C show the process of the above advance, and the lock arm 4 is flexed downward, and when the male housing B reaches a proper fitting position as shown in FIG. 6D, the lock arm 4 is resiliently restored, so that its retaining projection 6 is engaged in the retaining hole 1. As a result, the female and male housings A and B are locked relative to each other, and also the electrical connection between the above metal terminals is completed.

When the female and male housings A and B are fitted and locked relative to each other, the guide holders 10 supporting the retaining pins 14 enter the lock chamber A2, so that these holders 10 are disposed beneath the back-and-forth movement limitation pieces 2, respectively. As a result, the retaining pins 14 are disengaged from the guide holders 10, respectively.

Figure 7A:
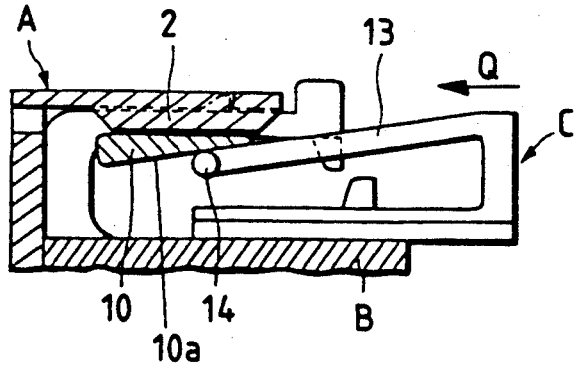
FIGS. 7A to 7C are cross-sectional views of an important portion, showing the process of retaining the lock assurance member relative to the female and male housings.
Figure 7B:
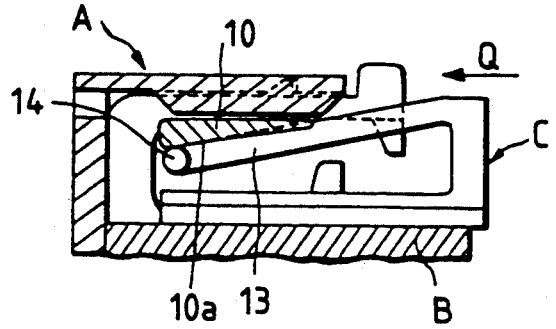

Then, when the lock assurance member C is pushed in a direction of arrow Q as shown in FIGS. 7A and 7B, the retaining pins 14 are brought into sliding contact with the tapered guide surfaces 10*a* of the guide holders 10, respectively, and the flexible retaining levers 13 are flexed downward. When the retaining pins 14 further advance and pass past the front ends of the guide holders 10 to be disengaged from these holders 10, the flexible retaining levers 13 are resiliently restored.

Figure 7C:
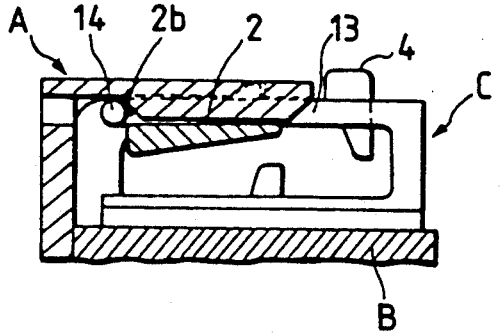

FIG. 7C shows this restored condition in which the retaining pins 14 are engaged respectively with the rear tapered surfaces 2*b* of the back-and-forth movement limitation pieces 2, and also are supported partially by the guide holders 10, respectively. Therefore, even if the lock assurance member C is pulled in a direction reverse to the above arrow Q, the lock assurance member can not be withdrawn, and therefore is completely retained relative to the female housing A.

As described above, after the female and male housings A and B are completely fitted and locked relative each other as shown in FIG. 6D, the lock assurance member C can be completely retained. In the incompletely-fitted condition as shown in FIG. 6C, the retaining pins 14 abut respectively against the tapered surfaces 2*a* of the back-and-forth movement limitation pieces 2 and the flexible retaining levers 13 can not move under the guide holders 10, thereby preventing the advance of the member C in a double manner. In addition, by the cooperation of the passage prevention piece 8 of the downwardly-flexed lock arm 4 as shown in FIG. 6C with the entry prevention piece 17 of the slide plate 16, the advance of the lock assurance member C is further prevented.

If the attaching of the lock assurance member C is ceased halfway as shown in FIGS. 7A and 7B, the tapered guide surfaces 10*a* urging the retaining pins 14 downward impart a rearward force (spring back) to the flexible retaining levers 13, so that the member C is moved back.

Therefore, by visually judging whether the lock assurance member C is in the completely-locked condition or not, it can be easily judged whether or not the female and male housings A and B are properly fitted and locked together.

Figure 7D:
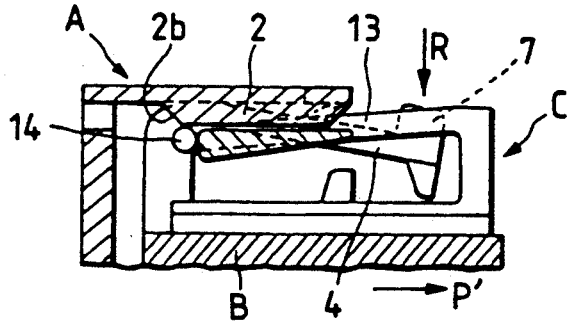
FIG. 7D is a cross-sectional view of the important portion, showing the manner of releasing the retaining of the lock assurance member.
Figure 8:
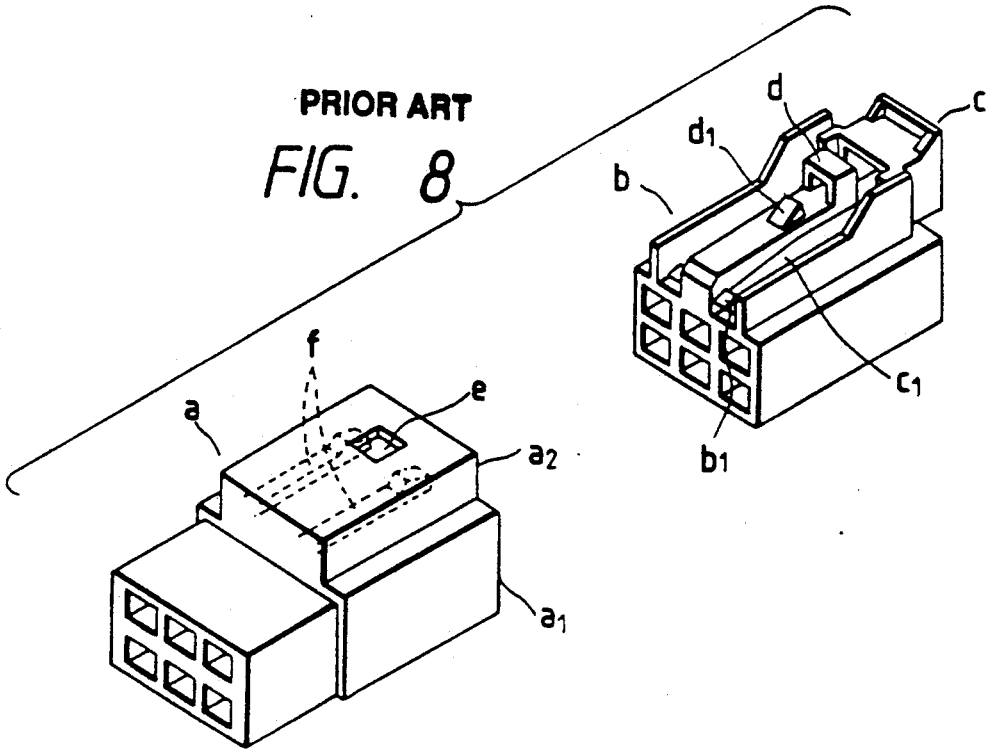
PRIOR ART FIG. 8
FIG. 8 is a perspective view showing female and male housings of the conventional art as separated from each other.

The disengagement of the male housing B from the female housing A is achieved by pressing the thumb piece 7 to release the locking made by the engagement between the retaining projection 6 and the retaining hole 1 as indicated by arrow R in FIG. 7D, and then by pulling the male housing B in a direction of arrow P'. When the male housing B is moved backward, the engagement of the retaining pins 14 with the back-and-forth movement limitation pieces 2 and the guide holders 10 is released, so that the lock assurance member C is moved backward together with the male housing B, and is returned to the initial condition shown in FIG. 6A.

As described above, in the present invention, at the time when the female and male housings are disconnected from each other, the resetting of the lock assurance member which is a cumbersome operation is not needed, and whether the fitted and locked condition is proper or not upon re-fitting can be easily judged positively, thereby enhancing the reliability in the electrical connection of the connector.

What is claimed is:

1. A lock assurance mechanism for a connector including a first housing with at least one terminal therein, a second housing adapted to be fitted to the first housing with at least one terminal mounted therein adapted to mate with the terminal of the first housing, a lock arm formed on an outer wall of said first housing through a fulcrum and displaceable about said fulcrum, and a lock retaining portion provided on said second housing for engagement with said lock arm, said first and second housings being locked together through said lock arm and said lock retaining portion upon fitting of said two housing relative to each other so that the terminals of the respective housings are in mating engagement, comprising:

a lock assurance member attached to said first housing and movable back and forth relative to said first housing, said lock assurance member having a flexible retaining lever which extends along said lock arm and has a retaining pin at a free end thereof;

a guide wall formed upright on said first housing and having a guide holder for supporting said retaining pin on the underside thereof; and a back-and-forth movement limitation piece provided on said second housing for limiting back and forth movement of said retaining pin; wherein when said first and second housings are fitted together to engage said lock arm with said lock retaining portion, said retaining pin which is abutted against said back-and-forth movement limitation piece is subsequently disengaged from said guide holder to allow the displacement of said flexible retaining lever; and subsequently by moving said lock assurance member forward, said retaining pin is brought into engagement with a rear surface of said back-and-forth movement limitation piece, thereby completely retaining said flexible retaining lever relative to said first housing.

2. The lock assurance mechanism according to claim 1, in which said lock assurance member includes a slide plate slidable along said guide wall of said first housing, and said flexible retaining lever extending from said slide plate via a fulcrum, there being provided retaining means between said slide plate and said first housing.

3. The lock assurance mechanism according to claim 2, in which a passage prevention piece is provided on said lock arm, an entry prevention piece being provided on said slide plate, and said entry prevention piece abutting against said passage prevention piece when said first and second housings are incompletely fitted together.

4. A connector comprising:

a first housing with at least one terminal therein;

a second housing adapted to be fitted to the first housing with at least one terminal mounted therein adapted to mate with the terminal of the first housing, said housings being relatively movable in a first direction with respect to one another toward a completely fitted position where said second housing is completely fitted to said first housing so that the terminals of the respective housings are in mating engagement;

locking means for maintaining said housings in said completely fitted position;

a lock assurance member attached to said first housing and movable in said first direction relative to said first housing, said lock assurance member having a body and at least one flexible retaining lever extending in said first direction from said body, said flexible retaining lever having a retaining pin at a distal end thereof;

at least one guide holder formed on said first housing, said guide holder having a first surface portion extending in said first direction and a second surface portion inclined with respect to said first direction; and at least one back-and-forth movement limitation piece formed on said second housing, said movement limitation piece having first and second tapered ends apart from each other a predetermined distance in said first direction; wherein during the movement of said housings relative to each other in said first direction toward said completely fitted position, said first tapered end and said first surface portion form a first retaining portion retaining said retaining pin therein to prevent said lock assurance member from being moved relative to said second housing, and at said completely fitted position of said housings, said second tapered end and said first surface portion form a second retaining portion, and said first tapered end and said first surface portion allow said retaining pin to be slidingly moved along said second surface portion toward said second retaining portion, to thereby allow said lock assurance member to be moved in said first direction relative to said second housing and retain said retaining pin in said second retaining portion.

* * * * *